United States Patent [19]

Racioppi

[11] Patent Number: 4,945,598

[45] Date of Patent: Aug. 7, 1990

[54] RAZOR CLEANING BRUSHES

[76] Inventor: Richard J. Racioppi, RR #1, Box 195, Mahomet, Ill. 61853

[21] Appl. No.: 377,073

[22] Filed: Jul. 10, 1989

[51] Int. Cl.[5] ..... A46B 9/02

[52] U.S. Cl. ..... 15/160; 15/218

[58] Field of Search ..... D4/104, 110, 113, 134, D4/135; 15/106, 159 R, 159 A, 160, 218, DIG. 5, 244.1, 211, 167.1, 167.3

[56] References Cited

U.S. PATENT DOCUMENTS

| | | | |
|---|---|---|---|
| 2,556,003 | 6/1951 | Sandell et al. | 15/211 X |
| 2,768,402 | 10/1956 | Back | 15/164 |
| 2,837,755 | 6/1958 | Jones | 15/106 |
| 4,453,285 | 6/1984 | Van Rosberg | 15/164 |

FOREIGN PATENT DOCUMENTS

| | | | |
|---|---|---|---|
| 571181 | 9/1958 | Belgium | 15/106 |
| 253922 | 11/1948 | Switzerland | 15/106 |

*Primary Examiner*—Philip R. Coe
*Assistant Examiner*—K. O'Leary
*Attorney, Agent, or Firm*—Dowell & Dowell

[57] ABSTRACT

Brushes for use in cleaning conventional safety razors which are selectively mounted to the wall in a bathtub or shower enclosure in such a manner that the free end of the bristles form a wiping plane which orients the bristles generally parallel to the plane of the blades of the razors so that the bristles will pass between the blades to thereby remove particles therefrom during a natural side-to-side motion of an individual's hand and wherein the brushes may be used to selectively support razors when not in use.

14 Claims, 2 Drawing Sheets

Fig.1
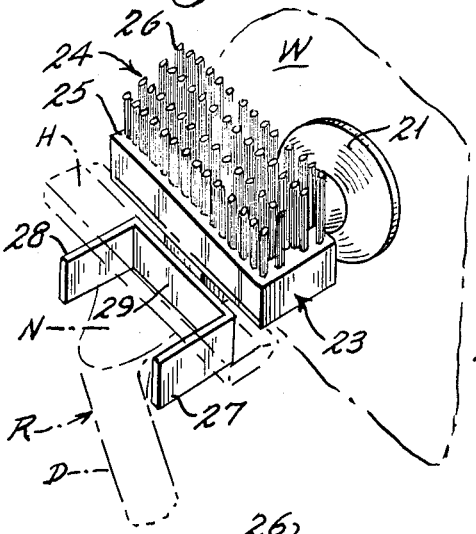
Fig.2
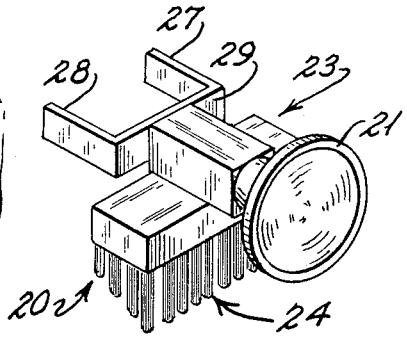
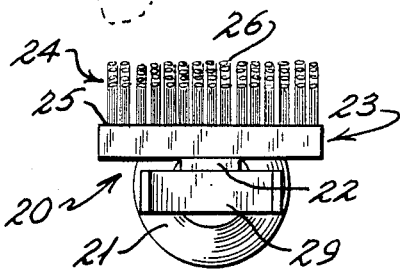
Fig.3
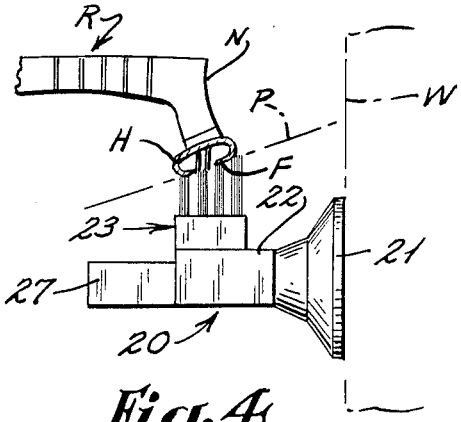
Fig.4
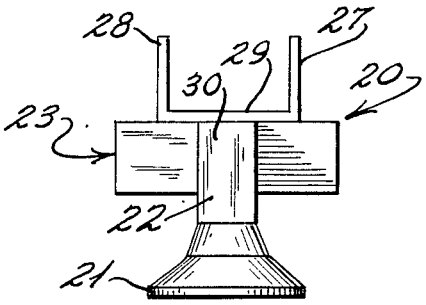
Fig.5
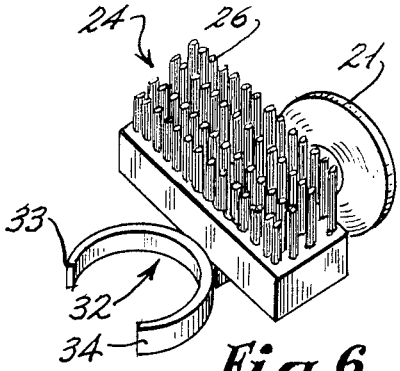
Fig.6

RAZOR CLEANING BRUSHES

CROSS REFERENCE TO RELATED APPLICATIONS

This application is related to applicant's prior U.S. patent application Ser. No. 07/240,474 filed Sept. 6, 1988 and entitled Razor Cleaning Device.

BACKGROUND OF THE INVENTION

1. Field of the Invention

This invention is generally directed to brushes for cleaning implements and more specifically to brushes which are specifically configured to clean safety razors. The bristles are selectively secured to the wall of a shower or bathtub enclosure which include a plurality of bristle elements having free ends which form a generally continuous wiping surface which in the preferred embodiment, tapers downwardly and outwardly at an acute angle with respect to a horizontal plane so as to be oriented in a position such that when the face of the razor head is applied flush against the wiping surface the bristles will be substantially parallel to the blade or blades of the razor so that the bristle elements will pass adjacent to the blade to thereby effectively remove hair cuttings and other material from adjacent the cutting blades when the razor is moved in a natural side-to-side motion. The brushes of the present invention also provide supports for suspending conventional safety razors therefrom when the razors are not in use to thereby insure that the razors are retained in a convenient and safe location when not in use.

2. History of the Related Art

In applicant's prior U.S. patent application Ser. No. 07/240,474 filed Sept. 6, 1988, a brush for mounting in a sink, basin and/or bathtub is disclosed which provides for a specific orientation of the brush bristles with respect to the water flowing from a faucet so as to facilitate the cleaning of hair, soap, cream, and skin particles from between the blades of a conventional safety razor. The concept behind such a brush is that the brush is mounted to a sink or tub in spaced relationship with respect to the faucet so that the bristle elements will extend in a direction such that the free ends thereof will define a generally continuous wiping surface which will permit a person utilizing the brushes to naturally position the blades of a conventional safety or disposable razor against the bristles in a parallel orientation to the elongated axis of the bristles. In this manner, the bristles may effectively pass between the razor blade or blades and the blade support head of the razor so as to remove hair and skin particles therefrom as the razor is moved in a natural side-to-side motion. Therefore, with the brush disclosed in applicant's prior application, it was possible to selectively secure the brush to a sink or tub in spaced relationship to the faucet and insure that the orientation of the wiping plane defined by the free end of the bristles was retained in a specific angular relationship to the surface of the sink or tub.

The advent of modern twin blade razors has significantly increased the difficulty associated with cleaning shavings and shaving cream from the gap between adjacent cutting blade edges of such razors. Razors of this type are sold under the trademarks TWIN-TRAC, ATRA, TRAC TWO, and ULTREX. These razors are characterized having two short, parallel, closely spaced blades which have two elongated edges. The edges of the two adjacent blades are staggered so that the second blade will cut a hair shaft as the first blade extends the hair shaft from the follicle. Shavings and shaving cream can become trapped between the blades and are difficult to dislodge. It is well known to those who use such razors that merely running the razor head under hot water may not be sufficient to thoroughly clean the blades. Thus, individuals typically tap the razor head against the side of the sink or wash basin to dislodge cuttings from between the blades while alternating running the razor head under a steady flow of water.

Unfortunately, the removal of hair cuttings, soap or cream and the like from between the cutting blades of a razor by utilizing running water and the tapping of the head against the sink or basin is rarely completely successful and the build-up of such material will result in reducing the cutting efficiency and cutting comfort of the razor blade. Therefore, most disposable razors are disposed of as the blades become clogged, well in advance of the useful cutting effectiveness of the cutting blades themselves. Also, the use of a continuous water flow to clean razors is a waste of water resources as well as energy resources.

Men and women who use single or twin blade razors, depending on their shaving habits, may use approximately two to three gallons of hot water in attempting to clean a razor while shaving. Electric and natural gas rates have risen sharply over the last few years necessitating conservation. Also, sources of water supply are becoming increasing more limited thus necessitating the need to take effective measures to promote the efficient use of water without waste. Although brushes of various shapes and sizes have been proposed, designed and manufactured over the years, most brushes have not been designed to facilitate the cleaning of the area of a safety razor adjacent or along the blades. The use of various conventional hand held brushes will not permit an effective cleaning of the cutting blades of conventional safety razors. This is in part due to the fact that the orientation of the bristle elements in a hand held brush will change depending upon the motion of the brush relative to the cutting blades of the razor. Unless the bristles are drawn across the cutting blades of the razor in parallel relationship to the cutting blades, the cutting blades will actually work to sever portions of the bristle element thereby further clogging the area between the cutting blades or between the blade and the support head of the razor. Not only will such a technique result in the clogging of the area of the cutting blades of the razor but the cutting of bristle elements will further reduce the cutting effectiveness of the blades. An additional factor associated with the use of any hand held brush for cleaning the blades of a safety razor is that if the brush element is brought into close proximity with the cutting edge of the razor, there is a significant chance or risk that the individual may accidently cut themselves as the razor is moved relative to the brush or visa versa.

Although there have been proposed numerous types of brushes which are designed to be fixedly mounted to a support surface so as to retain the bristle elements of the brush in a given orientation with respect to the support surface, most such cleaning brushes have not been designed for use in orienting the bristle elements so as to be substantially parallel to the blades of a razor so that the bristle elements will pass in parallel relationship with respect to the cutting blades to remove particles of hair and other material therefrom Although applicant's prior application discloses brush elements which are specifically designed to be fixedly secured to a support surface in such a manner that the bristle elements are oriented so as to be in parallel relationship to the cutting blades of a razor when the razor is moved naturally in a side-to-side motion, there are limitations with respect to the orientation of the brush elements which will not facilitate the use of such brushes when an individual is standing in a shower or taking a bath. For instance, many individuals and especially women who shave while taking a bath or in a shower are generally not standing in a relationship to a sink or basin in such a manner that the orientation presented by the wiping plane of the bristle elements of applicant's prior application would be in proper orientation for effective cleaning of the blades of a razor. Further, the use of a safety razor in a shower or tub presents another problem with regard to the safe placement or storage of the razor when the razor is not in use. This problem is generally not associated with the placement of a safety razor adjacent the sink where the razor may be set aside without fear of the razor blades being accidentally contacted when the razor is not in use. However, in a shower or tub, the razor may slide from the side of the tub or shower wall and be displaced along the floor of the shower or tub in such a position that the razor blades would be oriented in an unsafe manner upwardly from the surface of the tub or shower thereby creating a definite hazard.

SUMMARY OF THE INVENTION

This invention is directed to brushes for cleaning hair, soap, shaving cream and the like from the cutting blades of conventional safety razors and which include a base portion which is selectively mounted to a vertical surface in a shower or bathtub enclosure and a head portion which is secured to the base portion so as to be in generally perpendicular relationship with respect thereto. A plurality of bristles are mounted to the brush cleaning head and extend vertically upwardly therefrom. The free ends of the bristles form a continuous wiping surface with the bristle elements extending generally parallel to the cutting blades of a razor when the face of the razor head is applied against the free ends to thereby allow the free ends of the bristles to pass adjacent to the cutting blades of the razor to remove debris therefrom. In the preferred embodiment, the continuous wiping plane formed by the free ends of the bristles tapers downwardly and outwardly with respect to the vertical support surface to which the brush is mounted to thereby form a tapered wiping plane. The brushes of the present invention further include a pair of support arms which extend outwardly from the cleaning head to thereby provide a support in which the head of a conventional razor may be supported when the razor is not in use.

It is the primary object of the present invention to provide brushes for cleaning conventional single and double edge razors and which is selectively mounted to the wall or other vertical surface in a shower or bathtub enclosure so that the bristle elements of the brush are vertically oriented in order to be properly aligned parallel with the cutting blade of the razor when the razor is wiped across the free ends of the bristle elements to thereby allow the bristle elements to effectively remove hair, soap, shaving cream and other debris from the cutting blades.

It is yet another object of the present invention to provide specially designed brushes which may be utilized to facilitate the cleaning of the cutting blades of conventional hand held safety razors and which include bristle elements which are oriented with respect to the support surface in such a manner that the bristles will pass parallel to the blades of the razor when the razor is held in a conventional manner and wiped across the free ends of the bristle elements.

It is a further object of the present invention to provide brushes for cleaning the cutting blades of conventional safety razors which further include a support for retaining such razors when the razors are not in use to thereby facilitate the safe storage of razors.

It is a further object of the present invention to provide a safety device for use with conventional single and twin edge razors which incorporates a brush element which is mounted to a base which is selectively positioned along a wall of a shower or bathtub enclosure and which further includes a pair of spaced support arms for supporting a razor so that the razor will be retained in a safe position when not in use.

It is also an object of the present invention to provide low cost brushes which may be selectively positioned at an appropriate height within a shower or bathtub enclosure so as to allow the bristle elements of the brushes to be retained in a fixed orientation so that the heads of conventional safety razors may be wiped across the free ends of the bristle elements in such a manner as to effectively remove hair, shaving cream, soap and other particles from the blades of the razors.

BRIEF DESCRIPTION OF THE DRAWINGS

FIG. 1 is a perspective illustrational view showing a first embodiment of the present invention secured to the wall in a shower enclosure and showing in dotted line a conventional safety razor being supported by the pair of spaced support arms of the brush element.

FIG. 2 is a bottom perspective view of the embodiment of FIG. 1.

FIG. 3 is a front plan view of the embodiment of the invention as shown in FIG. 1.

FIG. 4 is a side elevational view of the embodiment shown in FIG. 1 illustrating in dotted line the placement of the brush on a vertical surface with a conventional razor being shown in dotted line being positioned to be drawn across the free ends of the bristles of the brush.

FIG. 5 is a bottom plan view of the brush of FIG. 1.

FIG. 6 is a perspective view of a second embodiment of the present invention.

DESCRIPTION OF THE PREFERRED EMBODIMENT

Figure 7:
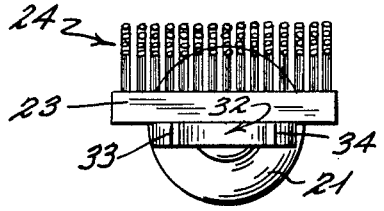
FIG. 7 is a front plan view of the embodiment shown in FIG. 6.
Figure 8:
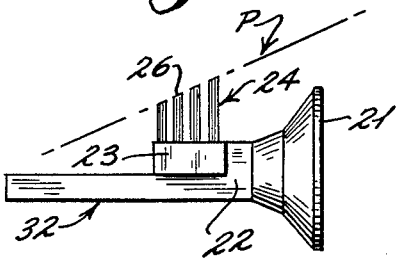
FIG. 8 is a side elevational view of the embodiment of brush shown in FIG. 6.
Figure 9:
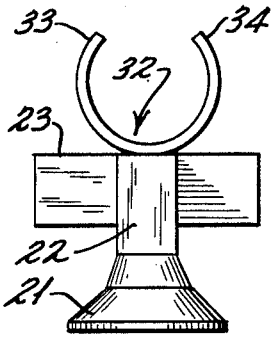
FIG. 9 is a bottom plan view of the embodiment of brush shown in FIG. 6.
Figure 10:
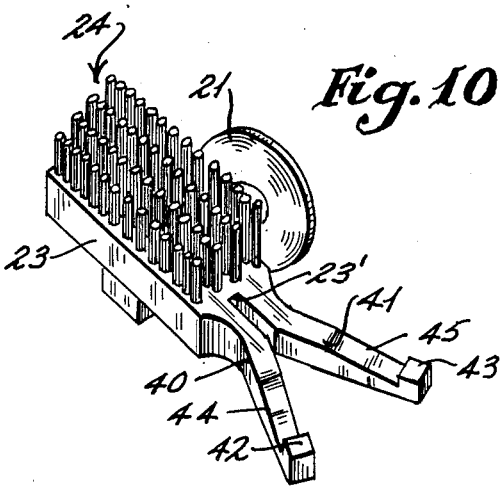
FIG. 10 is a perspective view of yet another embodiment of the present invention.
Figure 11:
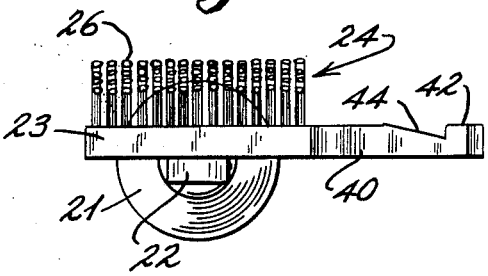
FIG. 11 is a front plan view of the embodiment of brush shown in FIG. 10.
Figure 12:
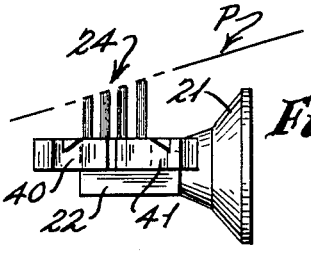
FIG. 12 is a side elevational view of the brush shown in FIG. 10.

With continued reference to the drawings, the first embodiment of the razor cleaning brushes of the present invention is disclosed in FIGS. 1–5, with a second embodiment being disclosed in FIGS. 6–9 and a third embodiment in FIGS. 10–13. Each of the elements of the three embodiments which are common with respect to one another will be identified using the same reference numbers. The brushes are specifically designed for cleaning the blades B of a conventional hand held safety razor R so as to improve the shaving characteristics of the blades and to prolong the usefulness of the life of especially disposable safety razors. The brushes are also specifically designed to be selectively retained on a vertical surface such as the wall W of a shower or bathtub enclosure so that the brushes will be retained in a specific orientation with respect to the support surface when the brushes are being utilized to clean safety razors.

The brush 20 shown in FIGS. 1–5 includes a base portion 21 which is shown as being in the form of a suction cup which is made of a material which may be collapsed against the wall W or other support surface and thereby retained against the surface by suction. A stem 22 extends from the suction cup base 21 with the length of the stem 22 depending upon the particular use for which the brush will be intended. In the drawing figures, the stem is shown as being relatively short so that the cleaning head portion 23 of the brush will be oriented in generally close proximity to the support surface or wall W. In some cases, however, it may be desired to elongate the stem 22 so that the head 23 of the brush will be oriented in remotely spaced relationship with respect to the support surface. This would especially be true when the brush is to be utilized in a bathtub with the brush being mounted beneath the faucet of the tub. In this case, the stem would be elongated so that the head of the brush 23 would be disposed generally vertically beneath the faucet so that water from the faucet would fall directly on the bristle elements 24 which are mounted to the cleaning head. Such an elongated stem is shown, for example, in FIG. 13 of the drawings which is a modification of the present embodiment. Generally, the stem could be anywhere from approximately one inch to approximately six inches in length. The shorter lengths would be preferred when the brush is to be utilized to support a razor when the razor is not in use such as illustrated in FIG. 1. In this type of embodiment, the brush would generally not be left in a mounted position within a tub but would be mounted along the wall of a shower or tub enclosure so as to be at a vertical height which would not be excessible to small children. By having the stem shortened, the brush will be out of the way and not subject to being accidentally hit or dislodged by an individual utilizing the shower or tub enclosure.

The head 23 of the brush is shown as having an upper surface which extends generally perpendicular with respect to the base 21 and therefore perpendicular to the wall or support surface W. The lower ends 25 of the bristle elements are mounted within the head 23 with the free ends 26 thereof extending upwardly. The free ends may be tapered as shown in the drawing figures but it is important that the free ends co-terminate in a common plane P so that a continuous wiping surface is established by the free ends of the bristle elements. The bristles are generally mounted in parallel rows as illustrated with the number of rows being variable. It is preferred that the free ends generally are closely spaced with regard to one another so that the bristles will pass on either side of the closely spaced blades of a razor as is illustrated in FIG. 4.

With further reference to FIG. 4 of the drawings, it is noted that in a conventional safety razor the head H is angularly oriented with respect to the elongated axis of the razor handle D. The bristle elements of the present invention are preferably tapered so that an angled wiping plan P is created. In this manner, as the face F of the head is lowered and positioned flush with respect to the wiping plane P defined by the upper free ends 26 of the bristles 24, the blades of the razor will be oriented parallel with respect to the bristle elements thereby allowing the bristle elements to effectively clean between the razor head and the blades without causing the blades to severe the bristle elements and without otherwise binding the bristle elements with respect to the blade. This will cause an effective cleaning of the blades thereby increasing the useful life of the razor blades.

Due to the angle at which the heads of most conventional safety razors are oriented with respect to the handles, and due to the angles at which the blades are mounted with respect to the razor heads, it has been determined that the wiping plane defined by the free ends of the bristles should be at an acute angle with respect to the horizontal and preferably approximately 20° but generally not greater than 45° .

Extending forwardly from the cleaning head 23 are a pair of spaced support arms 27 and 28 which are integrally connected to a common mounting flange 29 secured to the remote end 30 of the stem 22. The support arms 27 and 28 are spaced apart a distance sufficient to permit the neck portion N of a conventional safety razor to be received therebetween. As illustrated in FIG. 1, with the neck portion of the razor seated between the support arms 27 and 28, the head H of the razor will be cradled by the arms and effectively supported. The natural angle of the handle D of the razor will distribute the weight of the handle generally vertically in line with the head thereof so that the razor will not rock or otherwise tend to shift relative to the support arms 27 and 28 when the razor is supported therebetween. Further, as is illustrated, the cutting blades of the razor when supported by the brush element will be oriented toward the head 23 and therefore will be protected from being accidently contacted by an individual utilizing the tub or shower enclosure. By appropriately vertically spacing the brush element within a tub or shower enclosure, a conventional razor may be effectively supported when not in use at an elevation which is safely out of reach of small children thereby insuring that the razor will not be excessible and thus effectively preventing accidental injury.

With reference to FIGS. 6–9, a second embodiment of the present invention is shown in greater detail. In this embodiment, the brush element also includes a base 21 and a stem portion 22 to which is mounted a head portion 23. The bristle elements 24 define a similar wiping plane P as is illustrated in FIG. 4. The modification in this embodiment is in the support for the razor wherein, as opposed to providing separate support arms such as 27 and 28 of the first embodiment, a semi-circular support element 32 is shown as being mounted to the outer end 30 of the stem and includes arcuate opposing arm portions 33 and 34. As with the previous embodiment, the spacing or opening between the arcuate arm portions 33 and 34 is sufficient to allow the neck portion N of the razor to be inserted therethrough so that the head of the razor may be selectively seated on the arms when the razor is not in use.

The third embodiment of the present invention is shown in FIGS. 10–13. In this embodiment, the brushes also include the suction cup base portion 21 which is connected to the head 23 of the brush through the stem 22. The bristle elements 24 are formed in the manner described with respect to the embodiment of FIGS. 1–5 with the continuous wiping plane P also being defined by the free ends 26 of the bristles. In this embodiment, the support for the safety razor is provided along the side of the head as opposed to the outer end of the head so that a razor is retained in closer proximity to a wall or support surface W when not in use. Therefore, a pair of outwardly diverging support arms 40 and 41 are provided which extend outwardly from a side wall 23' of the head 23. The outermost portion of each of the arms 40 and 41 includes an upwardly extending flange element 42 and 43, respectively. The flange elements 42 and 43 serve to create stops to prevent a razor seated on the support arms from sliding outwardly from engagement therewith A pair of recessed areas 44 and 45 are also provided along the outer portion of the arms in which the head H of the razor may be selectively cradled when not in use.

Figure 13:
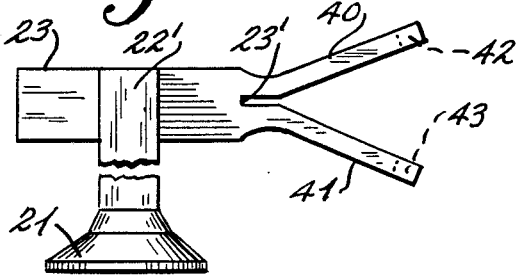
FIG. 13 is a bottom plan view of the brush shown in FIG. 10.

As was previously discussed with respect to FIG. 13, the stem 22' in FIG. 13 has been shown as being elongated for the purposes of allowing the bristle elements to be disposed generally vertically beneath the faucet in a bathtub enclosure thereby allowing the brush to be utilized in conjunction with the water issuing from the faucet.

In use of the brushes of the present invention, the brushes are selectively placed along a vertical surface within a shower or bathtub enclosure at a height to be above a level at which small children could gain access thereto. In this manner, when a brush is utilized to support a conventional safety razor, the razor will be retained at a safe elevation remote from a childs reach. The suction base of the brushes will insure that the brushes are retained in a selectively fixed position until selectively moved.

The height at which the brushes are placed is also determined by the height of the individual who will be utilizing the brush to clean a safety razor. It is preferred that the level of the brush be between the waiste and shoulders of the individual so that the brush will be conveniently positioned for wiping the razor in a normal side-to-side motion or movement of the individual's hand. With this type of placement, as the individual utilizes a conventional razor, they need only naturally extend their arm forward toward the brush and move their arm or hand laterally from side to side, wiping the blade or blades of the razor across the wiping plane formed by the free ends of the bristles to thereby effectively remove debris from the blades. Once the razor has been cleaned, the razor may be conveniently retained by the support arms of the brush.

I claim:

1. A razor cleaning device for selective placement on a vertical wall of a bathtub or shower enclosure to facilitate the cleaning of a razor having a handle and a head wherein the head includes an inclined face and at least one blade and in which the blade is exposed along the inclined face of the head of the razor, said device comprising, a base portion including a suction cup means, a stem having a first end connected to said suction cup means and a second end extending generally perpendicularly with respect to said suction cup means, a cleaning head carried by said stem, a plurality of generally parallel bristles having first ends connected to said cleaning head and free ends extending upwardly therefrom, said free ends of said bristles forming a substantially continuous wiping plane which extends outwardly from the vertical wall when said base portion is secured thereto, and a pair of spaced support arm means extending generally horizontally outwardly from said cleaning head, said support arm means being of a length to selectively support the head of the razor therebetween so that the razor will be supported by the cleaning device when not in use.

2. The razor cleaning device of claim 1 in which said free ends of said bristles are tapered so that said wiping plane is sloped downwardly and outwardly with respect to the vertical wall to which said base portion is selectively mounted.

3. The razor cleaning device of claim 2 in which the slope of said wiping plane is such that when the face of the head of the razor is brought into flush engagement with the free ends of the bristles, said bristles will be in generally parallel relationship with respect to the blades.

4. The razor cleaning device of claim 3 in which the the slope of said wiping plane is at an angle of between 20 and 45 with respect to the horizontal.

5. The razor cleaning device of claim 1 in which said cleaning head includes front and side wall portions, said spaced support arm means extending outwardly from said front wall portion of said cleaning head.

6. The razor cleaning device of claim 5 in which said support arm means are formed by a generally semi-circular element, said semi-eircular element having opposing curved arm segments.

7. The razor cleaning device of claim 1 in which said cleaning head includes front and side wall portions, said spaced support arm means extending outwardly from one of said side wall portions of said cleaning head.

8. The razor cleaning device of claim 7 in which each of said spaced support arm means includes an outer flange element which extends vertically upwardly with respect thereto.

9. A razor cleaning device for selective placement on a vertical wall of a bathtub or shower enclosure to facilitate the cleaning of a razor having a handle and a head wherein the head includes an inclined face and at least one blade which is carried by the head of the razor and wherein the blade is exposed along the face of the head of the razor with the face of the head being inclined at a first angle with respect to an elongated axis of the handle said device comprising, a base portion including a suction cup means, a cleaning head, means for connecting said cleaning head to said suction cup means, a plurality of generally parallel bristles having first ends connected to said cleaning head and free ends extending upwardly therefrom, said free ends of said bristles forming a substantially continuous wiping plane, said wiping plane being tapered downwardly and outwardly at a first angle with respect to the vertical wall when the base portion is secured to the vertical wall and at a second angle with respect to the horizontal, said second angle being such that when the inclined face of the razor is applied flush against said free ends of the bristles forming said wiping plane, said bristles will be generally parallel with respect to the blade of the razor and a pair of spaced support arm means secured to said cleaning head, said support arm means being of a length to support the head of the razor therebetween so that a razor may be selectively supported by the cleaning device when the razor is not in use.

10. The razor cleaning device of claim 9 in which said second angle is between 20° and 45°.

11. A razor cleaning device for selective placement on a vertical wall of a bathtub or shower enclosure to facilitate the cleaning of a razor having a handle and a head wherein the head includes an inclined face and at least one blade being exposed along said inclined face the cleaning device comprising, a base portion including a suction cup means, a cleaning head connected to said base, a plurality of generally parallel bristles having first ends connected to said cleaning head and free ends extending upwardly therefrom, said free end of said bristles forming a substantially continuous wiping plane which extends outwardly from the vertical wall when said base portion is secured thereto, and a pair of spaced support arm means extending generally horizontally outwardly from said cleaning head, said support arm means being of a length to support the head of the razor therebetween so that the razor will be supported by the cleaning device when not in use.

12. The razor cleaning device of claim 11 in which said free ends of said bristles are tapered so that said wiping plane is sloped downwardly and outwardly with respect to the vertical wall to which the base portion is selectively mounted.

13. The razor cleaning device of claim 12 in which the slope of said wiping plane is such that when the face of the head of the razor is brought into flush engagement with the free ends of the bristles, said bristles will be in generally parallel relationship with respect to the blades.

14. The razor cleaning device of claim 13 in which angle of the slope of said wiping plane is between 20° and 45° with respect to the horizontal.

* * * * *